US005689973A

United States Patent [19]

Naumovitz et al.

[11] Patent Number: 5,689,973

[45] Date of Patent: Nov. 25, 1997

[54] AIR SEPARATION METHOD AND APPARATUS

[75] Inventors: Joseph P. Naumovitz, Lebanon; Charles M. Brooks, North Plainfield, both of N.J.

[73] Assignee: The BOC Group, Inc., New Providence, N.J.

[21] Appl. No.: 649,147

[22] Filed: May 14, 1996

[51] Int. Cl.[6] ..... F25J 3/00

[52] U.S. Cl. ..... 62/652

[58] Field of Search ..... 62/652

[56] References Cited

U.S. PATENT DOCUMENTS 4,617,037 10/1986 Okada et al. ..... 62/652

5,205,127 4/1993 Agrawal ..... 62/652

5,385,024 1/1995 Roberts et al. ..... 62/652

*Primary Examiner*—Ronald C. Capossela

*Attorney, Agent, or Firm*—David M. Rosenblum; Salvatore P. Pace

[57] ABSTRACT

A method an apparatus for separating air in which an oxygen containing vapor stream is removed from a single column nitrogen generator and then divided into two subsidiary streams. The two subsidiary streams are condensed and then combined for stripping within a stripping column to produce ultra-high purity liquid oxygen as a column bottoms. One of the two subsidiary streams is condensed in a reboiler and a bottom region of the stripping column. The other of the two subsidiary streams is condensed within a head condenser used in connection with the nitrogen stripping column.

10 Claims, 1 Drawing Sheet

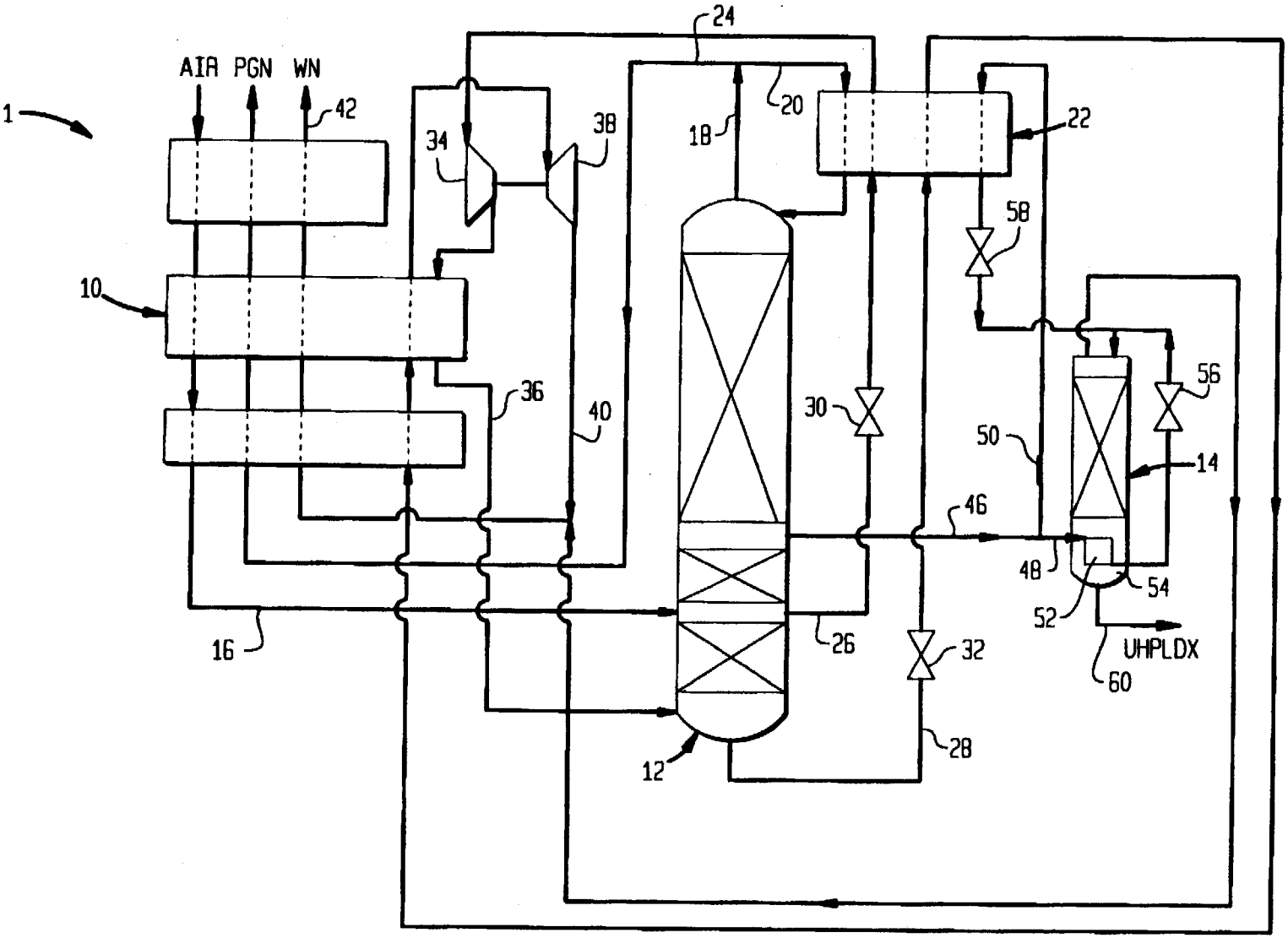
AIR
PGN
WN
UHPLDX
1
10
12
14
16
18
20
22
24
26
28
30
32
34
36
38
40
42
46
48
50
52
54
56
58
60

AIR SEPARATION METHOD AND APPARATUS

BACKGROUND OF THE INVENTION

The present invention relates to an air separation method and apparatus in which air is separated to produce an ultra-high purity liquid oxygen product. More particularly, the present invention relates to such a method and apparatus in which the air is separated in a single column nitrogen generator to produce an oxygen containing vapor fraction lean in heavy components of the air which, after liquefaction, is stripped of light components in a stripping column. Even more particularly, the present invention relates to such a method and apparatus in which the oxygen containing vapor fraction is divided into two subsidiary streams which are respectively liquefied in a reboiler located within the stripping column and in a head condenser of the single coltann nitrogen generator.

It is well known in the art to separate air to produce an oxygen-rich fraction which is lean in the heavy components such as carbon dioxide, water and hydrocarbons and then to strip a liquid stream, composed of the oxygen-rich fraction, of light components such as nitrogen, argon, neon, krypton, and helium. For example, U.S. Pat. No. 5,043,173 discloses a single column nitrogen generator in which a liquid stream is withdrawn from the nitrogen generator at a location thereof at which the liquid stream is composed of oxygen-rich liquid lean in the heavy components. The liquid stream is subsequently stripped within a stripping coltann by introducing the liquid into the top of the column to produce a descending liquid phase which becomes ever more concentrated in liquid oxygen and ever more dilute in the light components.

U.S. Pat. No. 5,043,173 also discloses a method of purifying an oxygen containing vapor stream removed from a high pressure column of a double column distillation unit. The oxygen containing vapor stream is subsequently liquefied in a reboiler of the stripping column before being stripped. In order to extract liquid from the stripping column, liquid nitrogen must be added to the stripping column. The problem in adding a liquid composed of nitrogen to a liquefied oxygen containing vapor stream is that the stripping column must be appropriately sized to strip a resultant combined stream having a lower purity than a liquid stream composed of oxygen-rich liquid. Furthermore, nitrogen production will suffer in direct portion to the liquid nitrogen removed.

As will be discussed the present invention provides a method and apparatus for separating air in which an oxygen containing vapor stream lean in heavy components is liquefied and stripped within a stripping column without addition of a liquid nitrogen stream to reflux the stripping column.

SUMMARY OF THE INVENTION

The present invention provides an air separation method in which a compressed and purified air stream is cooled to a temperature suitable for its rectification. The air stream is then rectified to produce an oxygen containing vapor fraction lean in heavy components. An oxygen-containing stream, composed of the oxygen containing vapor fraction, is divided into two subsidiary streams which are separately condensed. The two subsidiary streams after condensation are then stripped in a stripping coltann of light components present within the air stream so that ultra-high purity liquid oxygen is produced as column bottoms within the stripping column. One of the two subsidiary streams is condensed through indirect heat exchange with the column bottoms of the stripping column, thereby to produce boil up within the stripping column.

In another aspect the present invention provides an air separation apparatus having a means for cooling a compressed and purified air stream to a temperature suitable for its rectification. A means is provided for rectifying the air stream to produce an oxygen containing vapor fraction lean in heavy components. A stripping column is provided with a reboiler in the bottom region thereof to provide boil up within the stripping column. The reboiler is connected to the rectifying means so that one of two subsidiary streams composed of the oxygen containing vapor fraction condenses within the reboiler. A means is also connected to the rectifying means for condensing the other of the two subsidiary streams. The condensing means and the reboiler are connected to a top region of the stripping column so that the two subsidiary streams strip within the stripping column of light components and ultra-high purity liquid oxygen is produced as column bottoms within the stripping column.

As is evident from the foregoing description, the present invention has applicability to a single coltann nitrogen generator that is integrated with an ultra-high purity liquid oxygen stripping column having a reboiler. Since both liquid streams are separately condensed, the stripping column need only be designed to strip the oxygen-rich fraction and not an oxygen-rich fraction combined with nitrogen. Moreover, in case of a nitrogen generator, the other subsidiary stream can be condensed within a head condenser used in connection therewith. This of course will decrease the production of nitrogen product. However, such decrease will be less that would be the case had liquid nitrogen been removed because it is the coolant, usually oxygen rich liquid, that is condensing such subsidiary stream rather than liquid Hence, nitrogen production does not suffer to the same extent as in prior art oxygen purification schemes where it is desired to remove an oxygen containing vapor fraction for further purification within a stripping column.

As used herein and in the claims high purity nitrogen is nitrogen having an impurity content of less than about 100 parts per billion by volume of oxygen. Ultra-high purity liquid oxygen is oxygen having an impurity content of less than about 100 parts per billion (of impurities other than oxygen) by volume. Also the term, "fully warmed" as used herein and in the claims means warmed to a temperature of the warm end of the main heat exchanger or main heat exchange complex. The term, "fully" cooled" as used herein and in the claims means cooled to a temperature of the cold end of the main heat exchanger or heat exchange complex. The terms "partly warmed" or "partly cooled" as used herein and in the claims means warmed or cooled to a temperature between the warm and cold ends of the main heat exchanger or main heat exchange complex. Additionally the term, "light components" as used herein and in the claims includes but is not limited to nitrogen, argon, neon, helium, and hydrogen and the term, "heavy components" includes but is not limited to carbon dioxide, water, krypton and hydrocarbons.

BRIEF DESCRIPTION OF THE DRAWINGS

While the specification concludes with claims distinctly pointing out the subject matter that Applicant regards as his invention, it is believed that the invention will be better understood when taken in connection with the accompanying drawing in which the sole FIGURE is a schematic of an apparatus and method in accordance with the present invention.

DETAILED DESCRIPTION

With reference to the FIGURE, an air separation plant 1 is illustrated that is designed to separate air into a high purity nitrogen fraction and an ultra-high purity liquid oxygen fraction. Air after having been compressed and purified in a manner well known in the art is cooled in a heat exchanger complex 10 to a temperature suitable for its rectification which would normally be at or near the dewpoint of air. The air is then rectified within a single column nitrogen generator 12 into a high-purity nitrogen-rich fraction as tower overhead and an oxygen enriched liquid fraction as column bottoms. An oxygen containing vapor fraction is removed from single column nitrogen generator 10 at a location thereof at which such vapor fraction will be lean in heavy components. After condensation, such vapor fractions stripped within a stripping column 14 to produce the ultra-high pity liquid oxygen product. A point worth mentioning here is that the present invention is not limited to single column nitrogen generators and in fact, has wider applicability to multiple column plants. Having generally described the operation of apparatus 1, a more detailed description follows.

A compressed and purified air stream 16 which, as has been previously mentioned, is cooled within heat exchanger complex 10, is formed by compressing the air, removing the heat of compression, and then purifying the air of heavier components such as carbon dioxide, moisture and hydrocarbons. It is to be noted that even after such purification, however, such heavy components still exist within compressed and purified air stream 16 and will concentrate within liquid fractions produced from the rectification thereof.

Compressed and purified air stream 16 is then introduced into single column nitrogen generator 12. Single column nitrogen generator 12 contains liquid-vapor contacting elements such as trays, random or structured packing to rectify the air into the high-purity, nitrogen-rich and oxygen enriched liquid fractions. A nitrogen product stream 18 is produced which is composed of the high-purity, nitrogen-rich fraction. A part 20 of nitrogen product stream 18 is condensed within a head condenser 22 and then is recycled to single column nitrogen generator 12 as reflux. In this regard, head condenser 22 is a single pass unit of plate-fro construction. The other part 24 of nitrogen product stream 18 is fully warmed within main heat exchanger complex 10 where it is expelled at ambient temperatures as product nitrogen (PGN).

Coolant is supplied to head condenser 22 by way of removal of a liquid air stream 26 and a liquid oxygen enriched stream 28. Liquid air stream 26 and oxygen enriched stream 28 are valve expanded within valves 30 and 32, respectfully, and are vaporized within head condenser 22. The vaporized liquid air stream 26 is recompressed within a recycle compressor 34 to the operating pressure of single column nitrogen generator 12 to produce a recycle stream 36, which after having been partly cooled within heat exchanger complex 10, is introduced into a bottom region of single column nitrogen generator 12. In the illustrated embodiment, recycle stream 36 is not fully cooled so as to prevent liquefaction. Oxygen rich liquid stream 28 after having been vaporized is introduced into a turboexpander 38 to produce a refrigerant stream 40. Refrigerant stream 40 can be combined with other waste streams and then fully warmed within main heat exchanger complex 10 as a waste nitrogen stream 42. Such warming decreases the enthalpy of the incoming air in order to compensate for irreversibilities such as heat leakage into air separation plant 1. Recycle compressor 34 and turboexpander 38 can be coupled by an energy dissapative oil brake or a generator or the like so that some of the energy of the work of expansion can be recovered to power recycle compressor 34.

It is to be noted that embodiments of the present invention are possible which use a liquid stream having the same composition as oxygen-rich liquid stream 28 as the sole coolant for head condenser 22 and which thereafter is recirculated back to the column. However, the illustrated use of the vaporized liquid air stream 26 is particularly advantageous because it has a higher nitrogen content than the oxygen-rich liquid stream 28. As such, it has a higher dewpoint pressure for the same temperature of oxygen-rich liquid. Therefore, the supply pressure of vaporized liquid air stream 26 to the compressor is higher and thus, more flow can be compressed for the same amount of work. This increase in flow allows for an increase in heat pumping action which boosts recovery over that which would have been obtained had oxygen-rich liquid stream 28 been recirculated and returned to the column. Moreover, the stream composition of vaporized liquid air stream 26 is close to the equilibrium vapor composition in the sump of the column. This allows the bottom of the column to operate more reversibly than in the prior art.

The oxygen containing vapor fraction lean in the heavy components is withdrawn from single column nitrogen generator 12 as an oxygen containing vapor stream 46 which is divided into two subsidiary streams 48 and 50. Subsidiary stream 48 is condensed by passage through a reboiler 52 located within a bottom region 54 of stripping colunto 14. This provides boil up for stripping column 14. The resultant condensate is then reduced in pressure by pressure reduction valve 56. The other of the two subsidiary sueams 50 is condensed within head condenser 22 and then is reduced in pressure by a pressure reduction valve 58. The two subsidiary streams 48 and 50 are combined and then introduced into stripping column 14 to be stripped and thereby to produce the ultra-high purity liquid oxygen as an ultra-high purity liquid oxygen product stream 60.

Although the present invention has been described with reference to a preferred embodiment, as will occur to those skilled in art numerous changes, additions and omissions may be made without departing from the spirit and scope of the present invention.

We claim:

1. An air separation method comprising:

cooling compressed and purified air stream to a temperature suitable for its rectification;

rectifying said air stream to produce an oxygen containing vapor fraction lean in heavy components;

dividing an oxygen-rich stream composed of the oxygen containing vapor fraction into two subsidiary streams; and separately condensing said two subsidiary streams and stripping said two subsidiary streams in a stripping column of light components of said air stream so that ultra-high purity liquid oxygen is produced as column bottoms within said stripping column;

one of said two subsidiary streams being condensed through indirect heat exchange with said column bottoms of said stripping column, thereby to produce boil-up within said stripping column.

2. The air separation method of claim 1, wherein:

said air stream is rectified within a single column nitrogen generator to produce a nitrogen product stream;

a head condenser connected to said single column nitrogen generator condenses part of said nitrogen product stream, thereby to produce reflux for said single column nitrogen generator;

a remaining part of said nitrogen product stream is fully warmed; and the other of said two subsidiary streams is condensed within said heat condenser.

3. The air separation method of claim 2, wherein:

coolant for said head condenser is produced by extracting a liquid stream from said single column nitrogen generator and valve-expanding said liquid stream;

said liquid stream vaporizes within said head condenser; and said liquid stream after vaporization is recompressed to column pressure of said single column nitrogen generator, cooled to said temperature suitable for rectification and is recycled into said single column nitrogen generator.

4. The air separation method of claim 3, further comprising:

supplying additional coolant to said head condenser by withdrawing an oxygen-rich liquid stream from a bottom region of said single column nitrogen generator and valve expanding said oxygen-rich liquid stream;

vaporizing said oxygen-rich liquid stream within said head condenser and partially warming said vaporized oxygen-rich liquid stream;

turboexpanding said oxygen-rich liquid stream to produce a refrigerant stream; and fully warming said refrigerant stream through indirect heat exchange within said compressed and purified air stream, thereby to add refrigeration.

5. The method of claim 4, wherein tower overhead of said stripping column is fully warmed along with said refrigerant stream and said remaining part of said product nitrogen stream through indirect heat exchange with said compressed and purified air stream.

6. An air separation apparatus comprising:

means for cooling a compressed and purified air stream to a temperature suitable for its rectification;

means for rectifying said air stream to produce an oxygen containing vapor fraction lean in heavy impurities;

a stripping colttrnn having a reboiler in a bottom region thereof to provide boil-up within said stripping column;

said reboiler connected to said rectifying means so that one of two subsidiary streams composed of said oxygen containing vapor fraction condenses within said reboiler;

means also connected to said rectifying means for condensing the other of said two subsidiary streams;

the condensing means and said reboiler connected to a top region of said stripping column so that said two subsidiary streams are stripped within said stripping column of light impurities and ultra-high purity liquid oxygen is thereby produced as column bottoms within said stripping column.

7. The air separation apparatus of claim 6, wherein:

said rectifying means comprises a single column nitrogen generator to produce a nitrogen product stream;

a head condenser is connected to said single column nitrogen generator to condense part of said nitrogen product stream, thereby to produce reflux for said single column nitrogen generator;

said head condenser is configured to receive and condense the other of said two subsidiary streams and thereby act as said condensing means;

said cooling means fully warms a remaining part of said nitrogen product stream.

8. The air separation apparatus of claim 7, wherein:

said head condenser is also connected to said single column nitrogen generator and is configured to receive a liquid stream therefrom as coolant for said head condenser, said liquid stream thereby vaporizing within said head condenser;

an expansion valve is interposed between said head condenser and said single column nitrogen generator to valve expand said liquid stream; and a recycle compressor is connected to said head condenser to recompress said liquid stream after vaporization to column pressure of said single column nitrogen generator;

said cooling means also cools said liquid stream after said vaporization and recompression thereof to said temperature suitable for rectification; and said single column nitrogen generator is connected to said cooling means so that said liquid stream after cooling is recycled into said single column nitrogen generator.

9. The apparatus of claim 8, further comprising:

said head condenser also being connected to said single column nitrogen generator and being configured to receive an oxygen-rich liquid stream from said single column nitrogen generator as additional coolant, thereby to vaporize said oxygen-rich liquid stream;

another expansion valve interposed between said head condenser and said single column nitrogen generator for valve expanding said oxygen-rich liquid stream;

said cooling means partially warming said vaporized oxygen-rich liquid stream;

a turboexpander connected to said cooling means so that said oxygen-rich liquid stream is turboexpanded to produce a refrigerant stream; and said cooling means fully warming said refrigerant stream through indirect heat exchange within said compressed and purified air stream, thereby to add refrigeration.

10. The apparatus of claim 9, wherein said cooling means fully warms tower overhead of said stripping column along with said refrigerant stream and said remaining part of said product nitrogen stream through indirect heat exchange with said compressed and purified air stream.

* * * * *